United States Patent [19]

Rossman

[11] Patent Number: 4,484,430

[45] Date of Patent: Nov. 27, 1984

[54] CONNECTOR FOR A STRUCTURAL MEMBER

[75] Inventor: Wendell E. Rossman, 3137 N. 53 St., Phoenix, Ariz. 85018

[73] Assignee: Wendell E. Rossman, Phoenix, Ariz.

[21] Appl. No.: 389,891

[22] Filed: Jun. 18, 1982

Related U.S. Application Data

[63] Continuation-in-part of Ser. No. 291,839, Aug. 10, 1981, abandoned.

[51] Int. Cl.[3] ..... E04C 3/30

[52] U.S. Cl. ..... 52/726; 403/174; 403/178

[58] Field of Search ..... 52/726, 727, 80, 81, 52/648, DIG. 10, 236.1, 236.2, 665, 632, 82, 86, 127.7, 127.12, 227, 93, 309.3, 729, 585; 403/171, 172, 174, 176, 178, 217, 218, 205, 8, 7, 403, 260, 252, 300, 301, 267, 268; 14/13-15

[56] References Cited

U.S. PATENT DOCUMENTS

| | | | |
|---|---|---|---|
| 3,118,694 | 1/1964 | Bernard | 403/301 |
| 3,313,199 | 4/1967 | Houvener | 52/585 |
| 3,405,592 | 10/1968 | Blodee | 52/585 |
| 3,810,342 | 5/1974 | Scott | 52/81 |
| 3,820,293 | 6/1974 | Ohe et al. | 52/127.12 |
| 3,866,273 | 2/1975 | Brandestini et al. | 403/267 |
| 4,009,550 | 3/1977 | Young | 52/127.7 |
| 4,027,449 | 6/1977 | Cilveti | 403/171 |
| 4,137,115 | 1/1979 | Lambert | 403/268 |
| 4,231,198 | 11/1980 | Augier et al. | 52/93 |

FOREIGN PATENT DOCUMENTS

| | | | |
|---|---|---|---|
| 1450635 | 5/1965 | France | 403/174 |
| 1454527 | 10/1966 | France | 52/80 |

*Primary Examiner*—John E. Murtagh
*Assistant Examiner*—Kathryn Ford
*Attorney, Agent, or Firm*—Kenyon & Kenyon

[57] ABSTRACT

The one-piece steel connector is secured to an end face of a laminated timber via tendons which are embedded in the timber and nuts which are threaded onto the ends of each tendon. In one embodiment, a connector is secured to a cylindrical hub via bolts which are threaded radially into the hub. In another embodiment, a connector connects two co-linear timber members together. In another embodiment, a connector connects two angularly disposed timber members together.

19 Claims, 12 Drawing Figures

Fig. 7.
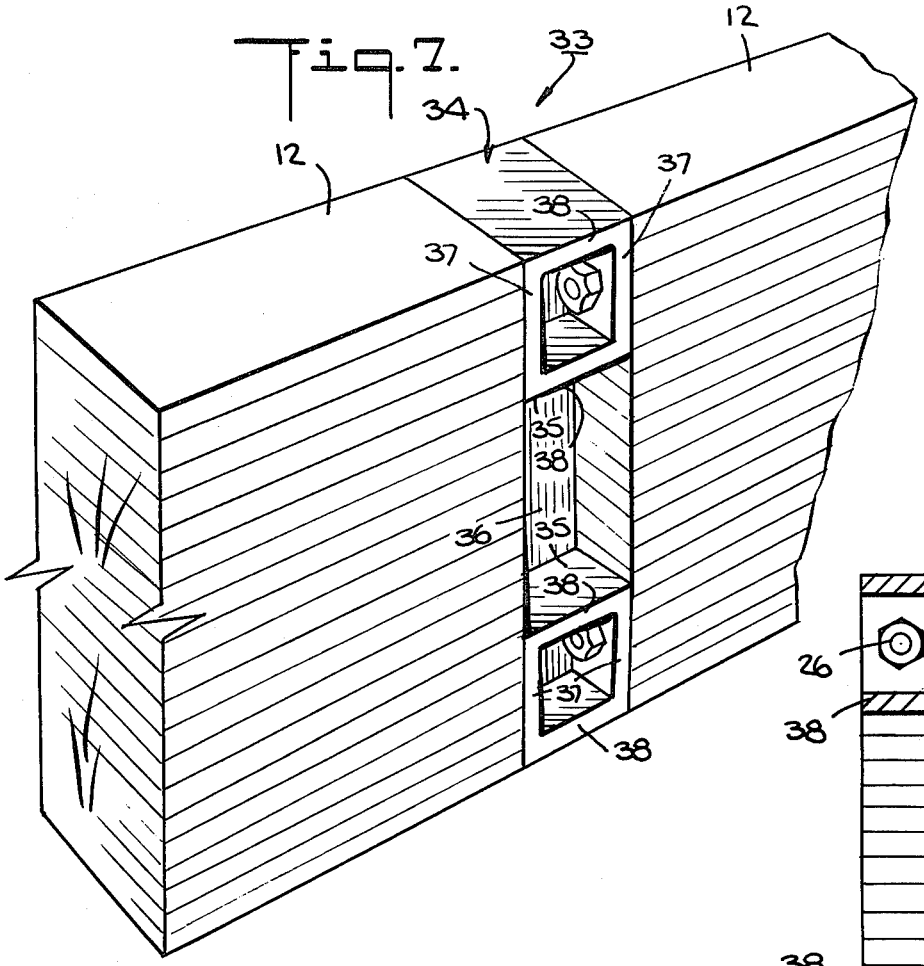
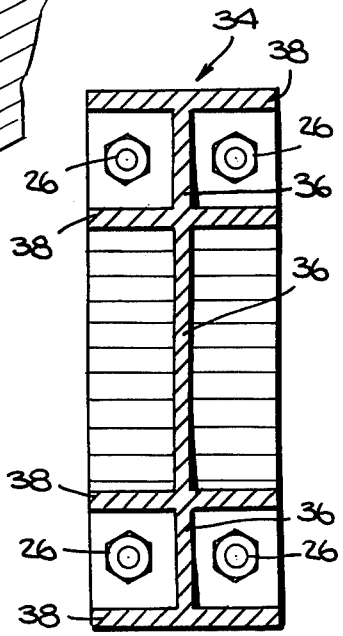
Fig. 9.
Fig. 8.
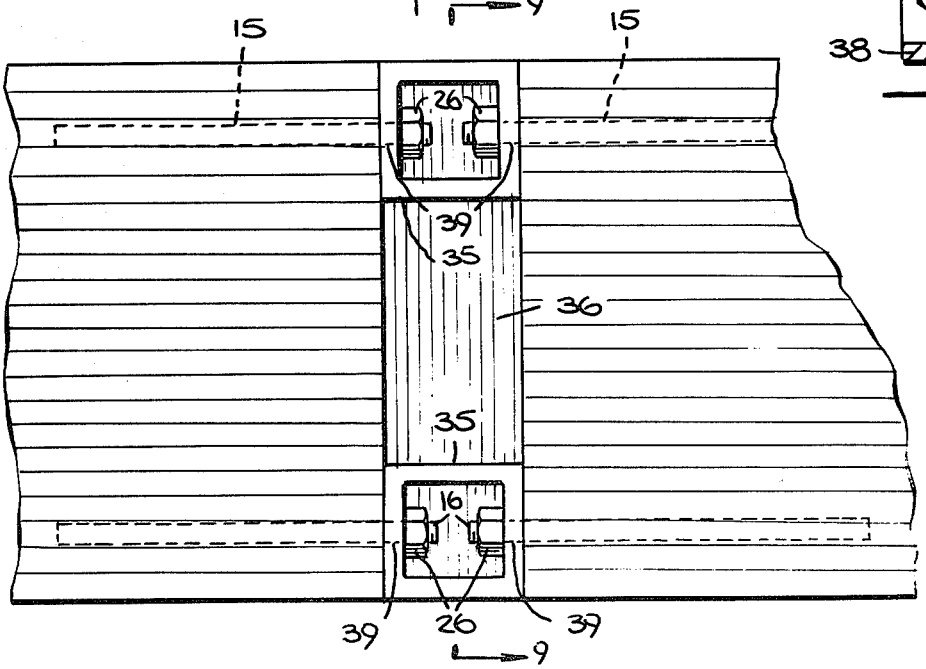

CONNECTOR FOR A STRUCTURAL MEMBER

This is a continuation-in-part of Ser. No. 291,839 filed Aug. 10, 1981 now abandoned.

This invention relates to a connector for a structural member. More particularly, this invention relates to a joint formed of heavy timber structural members and a hub.

Heretofore, various types of connections have been known for interconnecting structural members. For example, in the case of structural steel members such as beams, girders, columns and the like, it has been known to connect the members to each other via rivets or bolts. In the case of timber members, it has been known to use connectors to interconnect the members together. Generally, these connectors have used penetrating cross bolts and/or shear rings to restrain the timber members. These bolts have, in turn, been externally fixed to steel plates, straps and shoes or other materials including other timber members, for example, as described in U.S. Pat. Nos. 3,486,278 and 3,810,342.

In the case of space frame timber structures, such as reticulated shells, trusses and the like, rigid hub members are placed between the timber members to provide fixity and end bearing. In this case, shoes and/or lateral straps have been connected to the timbers and bolted to the hub, for example, to tension the timber face against the hub structure.

However, the various connectors used for timber construction have various limitations. For example, the bolts subject the timber fibers to compression perpendicular to the grain across their diameter and length and are themselves placed under shear stresses at the contact face. Thus, due to the softness of wood and the necessary manufacturing tolerances, cross bolts are also subject to some bending stresses. Further, the known connectors do not properly lend themselves to mass production due to the great variance of timber cross-sections and angles of radiation from a hub. This is one of the largest contributing factors to the high cost of the connectors. Still further, the basic method of compressing wood fibers against a perpendicularly oriented circular steel bolt is inefficient since only a small segment of the one-half circumference of the bolt can utilize the full end grain resistance of the wood; the other segments become progressively less effective, reaching zero at tangent areas. Still further, the necessary removal of wood fiber to accommodate the bolts weakens the structural strength of the timber. This usually occurs in the higher stressed zones and requires the timber to be sized larger in order to maintain the necessary safety factor.

Also, in order to distribute the stress transmitting zones of the timber, long and/or large area lateral plates are necessary. This substantially increases the weight and cost of a connector.

In cases where two timber beams are to be connected together, the most common in-line splice techniques have employed diagonal straps and lateral plates. In both cases, the timber beams have been step cut at the ends to be spliced in order to provide a support ledge for one end.

Generally, the diagonal straps have been looped over the supporting beam end, then traversed diagonally across the step-splice on both sides and then looped below the supported beam end. Thus, the vertical load from the supported beam end is transferred to the supporting beam. Suitable pins are also provided to hold the looped straps in place.

The lateral plates have usually been in the form of pieces of material which bridge across the splice. The cross-sectional area and length of these plates generally vary with desired fixity.

However, while full fixity end-to-end connections are theoretically possible with diagonal straps and lateral plates, as a practical matter, this involves disproportionately oversized and uneconomic plates and bolts.

Accordingly, it is an object of the invention to provide a connector for a structural member which is of relatively inexpensive construction.

It is another object of the invention to provide a connector for timber construction which is of relatively light-weight simple construction.

It is another object of the invention to provide a connector for timber construction which can be adapted to different timber cross-sections.

It is another object of the invention to efficiently transfer stress between the members of a timber construction joint in a space frame structure.

It is another object of the invention to provide a connector for timber construction which can be readily manipulated in the field.

Briefly, the invention provides a connector for a structural member having a base for abutting an end of the structural member, at least one aperture in the base for receiving a tendon extending from the structural member, and a web extending from the base.

In one embodiment, the connector is used to connect a timber structural member to a central hub. In this embodiment, the connector also has an apex for engaging the hub with at least one aperture in the apex for receiving a bolt and a pair of converging side walls between the base and apex so that the connection can be incorporated in a joint including a plurality of radiating connectors. For example, the converging side walls of the connection may be disposed at any angle from 25° to 90° and preferably from 30° to 60°.

The connector is made, for example, of steel and is recessed on opposite sides in order to define spaces to receive the tendons and bolts while defining a web. In addition, a nut threaded onto the end of the tendon is used to secure the connector to the structural member.

In another embodiment, the connector is used to connect or splice two timber structural members together. In this case, the connector has a pair of bases and a pair of stiffeners interconnecting the bases to define a box-shaped section. Each base also has a pair of apertures to receive a pair of tendons. The web interconnects the bases and stiffeners and is disposed between the apertures in each base.

In still another embodiment, the connector is used to connect at least two angularly disposed structural members together. In this case, the connector has at least a pair of bases disposed in angular relation with the web interconnecting the bases and at least one stiffener interconnecting the bases and the web.

The invention further provides an elongated timber structural member having at least one threaded tendon embedded longitudinally therein with one end extending from an end of the member. The member can be a sawn timber or a laminated timber with a plurality of longitudinally disposed laminations brought together in conventional manner. In either case, a longitudinal bore is drilled or otherwise formed in the member for receiving the tendon. The member is also provided with a transverse filler hole which communicates with the bore to permit an epoxy resin to be supplied to the bore to secure the tendon in place.

The timber member is generally of a rectangular cross-section and has a pair of connectors disposed at the end of the member in spaced relation to each other. However, the structural member may have other cross-sections such as an I-shaped cross-section, again with a pair of connectors at the end of the member with each connector being of a width equal to the width of a respective section of the member. In each case, the connectors are positioned to correspond with the respective compressive and tensile stress regions of the structural member.

In the case where the connector co-operates with a hub, a bolt passes through the apex of the connector into the hub. In this case, the hub may have a tapped bore to receive the bolt or a nut may thread onto the bolt from within the hub in order to secure the connector to the hub. In this respect, the hub may be of cylindrical shape while the connector has a rounded apex to mate against the hub. Further, the hub may be of hollow construction and may be provided with at least one stiffener therein. Where the hub is provided with stiffeners, for example, stiffener plates, each plate may have a tapped central hole permitting the insertion of a lift or support ring. For very small connectors, the hub may also be a solid round bar with tapped holes only.

A multiplicity of timber members with connectors thereon can be mounted on a single hub in a radiating manner to form a joint, for example, in a space frame structure. In this case, the generated angle between two radiating members of the joint determines the overall maximum length of a connector while the access to tighten the nuts determines the minimum length. Further, the timber member ends determine the face width of each connector. Generally, the connectors can be made in several standard sizes to accommodate various generated angles and timber widths.

The invention thus provides a connector which can be made in standardized mass produced sizes thus lowering cost. As the connectors are fully integrated, there is no further work necessary to incorporate the connectors into a joint.

The hub can be made simply by cutting a length of pipe to the required length and then by drilling and tapping holes for bolts at the calculated angle pattern of the connectors.

The tendons which are embedded in the structural members are of a length determined on the basis of allowable shear between the member and the epoxy resin. These tendons may be factory or field installed.

These and other objects and advantages of the invention will become more apparent from the following detailed description taken in conjunction with the drawings wherein:

FIG. 7 illustrates a perspective view of a joint formed by a modified connector according to the invention with two coaxial timber beams;

FIG. 8 illustrates a side view of the joint of FIG. 7;

FIG. 9 illustrates a view taken on line 9—9 of FIG. 8;

Figure 1:
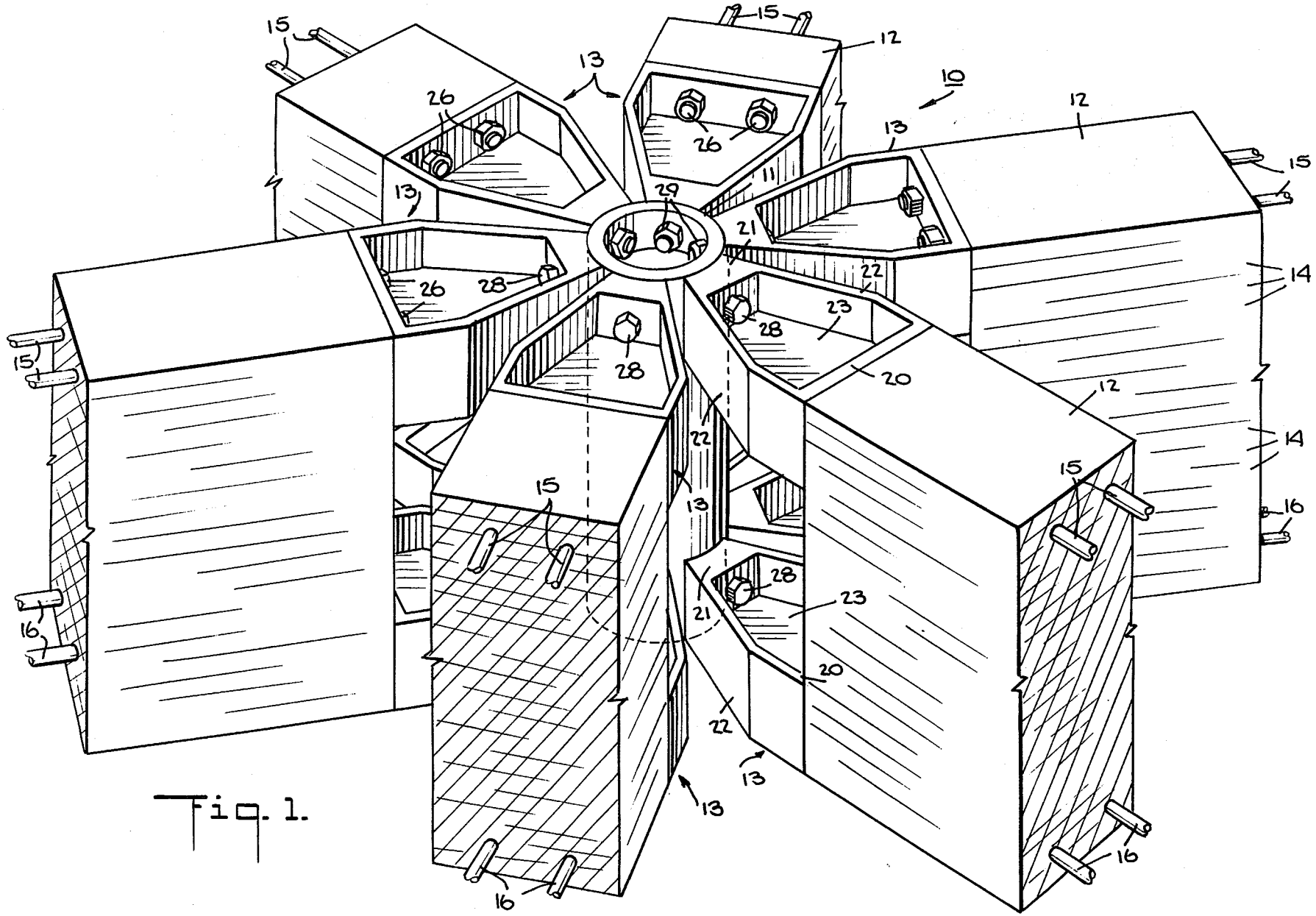
FIG. 1 illustrates a joint of a space frame constructed in accordance with the invention.

Referring to FIG. 1, a joint 10 of the space frame construction is composed of a hub 11, a plurality of structural members 12 which are disposed in a radiating manner about the hub 11 and a plurality of connectors 13 each of which secures a respective structural member 13 to the hub 11.

The hub 11 is formed as a hollow cylinder and is preferably made of a thick walled steel pipe. As indicated in FIG. 1, the hub 11 is of a length equal to the depth of the structural members 12 radiating from the hub 11 while being of a diameter less than the width of a structural member 12. In some cases, however, the hub may have a diameter greater than the width of a structural member secured thereto.

Figure 3:
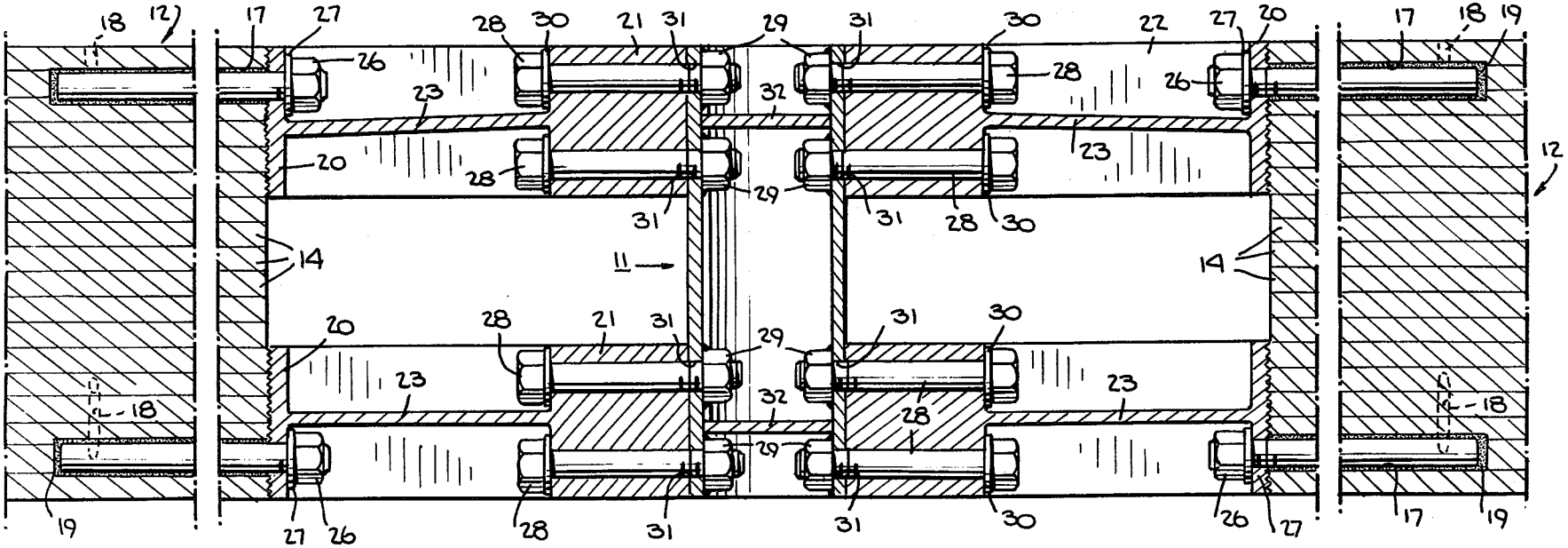
FIG. 3 illustrates a cross-sectional view taken on line 3—3 of FIG. 2.
Figure 4:
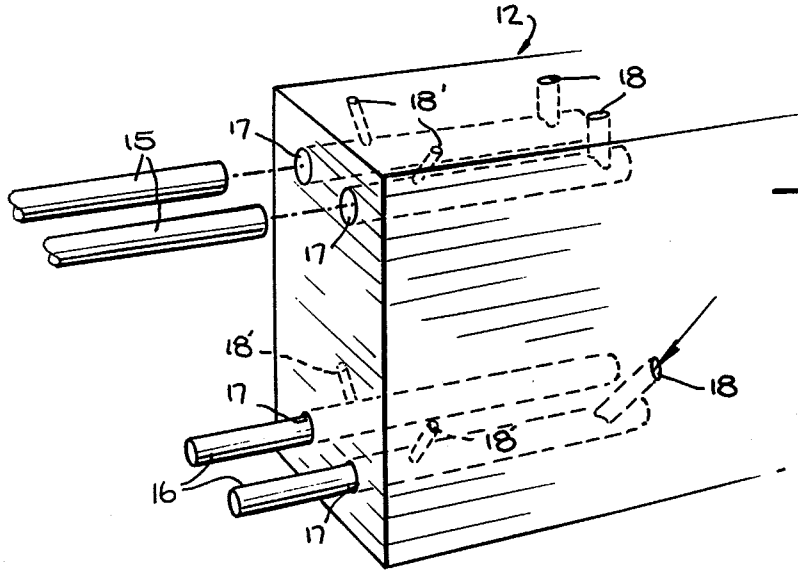
FIG. 4 illustrates a partial exploded view of a structural member constructed in accordance with the invention.

As shown in FIGS. 1 and 3, each structural member 12 is a timber formed of a plurality of longitudinally disposed laminations 14 which are bonded together in any suitable known manner to form a beam or the like. In addition, each timber member 12 has pairs of steel tendons in the form of threaded rods 15, 16 embedded longitudinally within the laminations with one end of each tendon 15, 16 extending from the end of the timber member 12. As shown in FIG. 1, one pair of tendons 15 is disposed in the tensile stress region of a timber 12 while the other pair of rods 16 is disposed in the compressive stress region of a timber 12. Of course, a member may undergo a stress reversal, in which case the tendons 15, 16 would be in the reversed stress regions, i.e., compressive and tensile respectively. As indicated in FIG. 4, each timber 12 has longitudinal bores 17 parallel to the grain for receiving the respective tendons 15, 16. Also, each bore 17 communicates with a transverse hole 18 which extends to the outside of the timber 12 and is sized to permit an epoxy resin or the like 19 (FIG. 3) to be injected into a bore 17 to secure a respective rod 15, 16 in place. Each bore 17 also communicates with a transverse air bleed hole 18' near the end of the timber 12 to allow air to bleed during injection of the epoxy 19.

The tendons 15, 16 are threaded in order to increase the bond to the laminated timber 12 and each is of a length determined on the basis of allowable shear between the timber 12 and epoxy 19. In use, the tendons 15, 16 may be installed in the factory or in the field.

Figure 2:
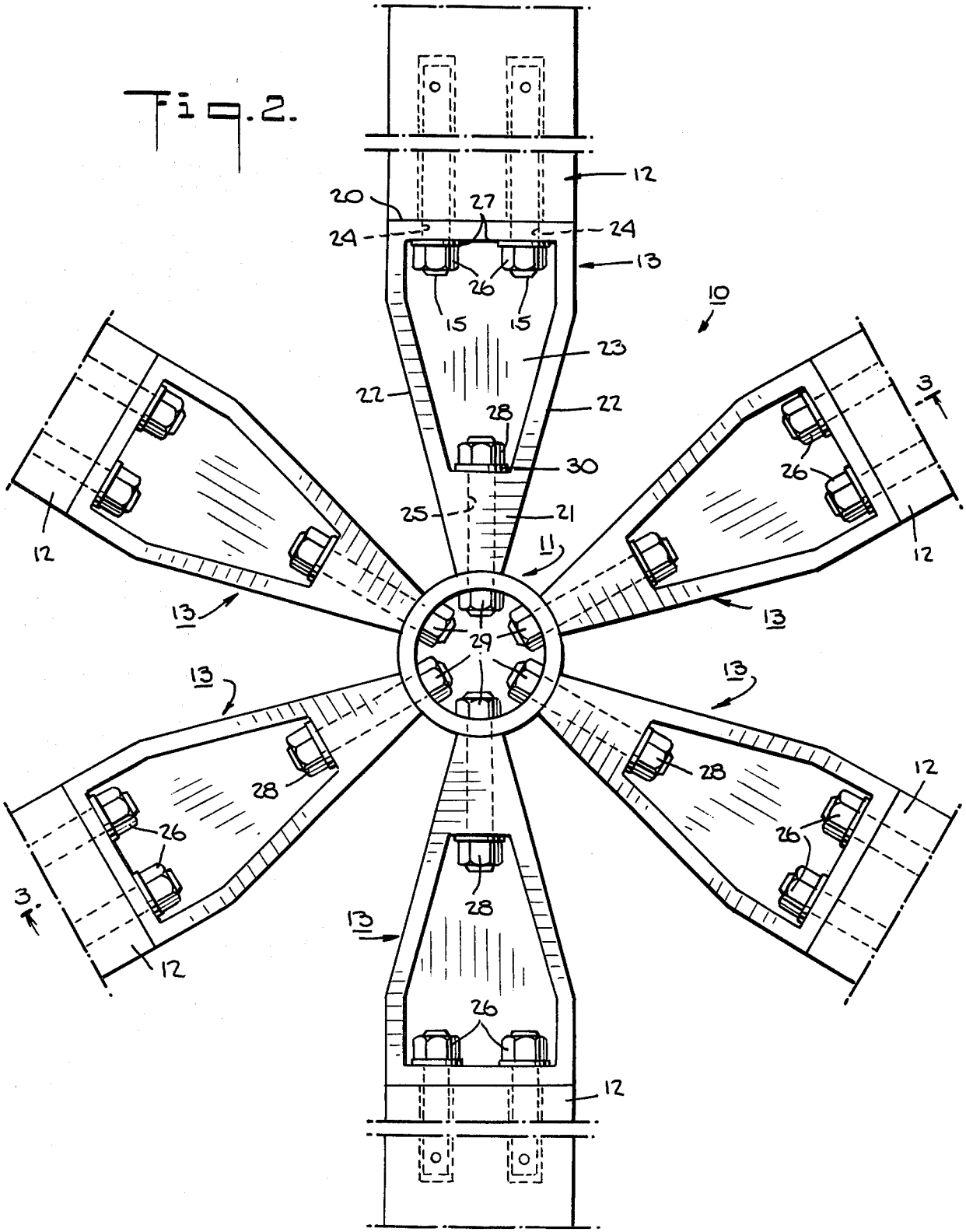
FIG. 2 illustrates a plan view of the joint of FIG. 1.

Referring to FIGS. 1-3, each connector 13 is of arrowhead shape and is made, for example, by casting or forging, or welding of steel pieces together as a one-piece member. Each connector 13 is disposed coaxially of a timber 12, has a base 20 which is abutted against an end of a timber 12 and is serrated to increase shear friction and enhance the abutment. In addition, each connector 13 has an apex 21 of smaller width than the base 20 for engaging the hub 11 and a pair of converging side walls 22 between the base 20 and apex 21 which define an included angle, for example, of from 30° to 60°. The apex 21 is shaped to abut the hub 11 and, for example, is rounded on a circular arc. Each connector 13 is also recessed on two opposite sides in order to define a central web 23.

As indicated in FIGS. 2 and 3, the base 20 of each connector 13 is provided with a pair of apertures 24 which are sized to receive the threaded tendons 15, 16 of a timber 12. As indicated in FIG. 3, the pair of apertures 24 is located to the outside of the web 23 of the connector 13 relative to the timber 12, Each connector 13 also has a pair of apertures 25 in the apex 21 which are vertically aligned as viewed in FIG. 3. These apertures 25 are disposed on opposite sides of the web 23 (see FIG. 3).

The arrangement of the tendons 15, 16 on the base 20 of the timber 12 is such as to provide post-tensioning of the tendons 15, 16. This preloads the bearing of the timber 12 against the connector 13.

As shown in FIG. 3, nuts 26 are threaded onto the ends of the tendons 15, 16 against suitable washers 27 to secure the connectors 13 to the timbers 12. In addition, bolts 28 pass through the apex 21 of each connector 13 and are threaded into nuts 29 which are prewelded into place within the hub 11 to secure the connector 13 to the hub 10. Suitable washers 30 are also disposed between each bolt head and the apex 21.

As shown in FIG. 3, the hub 11 is provided with apertures 31 to receive the bolts 28 and stiffeners in the form of plates 32 in places located between the pairs of bolts 28. These plates 32 may also be provided with a hole (not shown) in order to receive a lifting hook or the like. The plates 32 are also prewelded into place. For example, the internal nuts 29 are welded in first, then a plate 32 and then the external nuts 29. Thus, no field welding is necessary.

As shown in FIG. 1, each timber 12 is provided with a pair of connectors 13 which are disposed in spaced apart relation. One connector 13 is located in the compressive stress area only of the timber 12 whereas the other connector 13 is located in the tensile stress area only of the timber 12. Thus, the neutral zone has no steel.

As indicated in FIG. 3, the web 23 of a connector 13 may be disposed in a slight angular relation to the base 20. Alternatively, the webs 23 may be disposed in perpendicular relation to the base 20.

Figure 5:
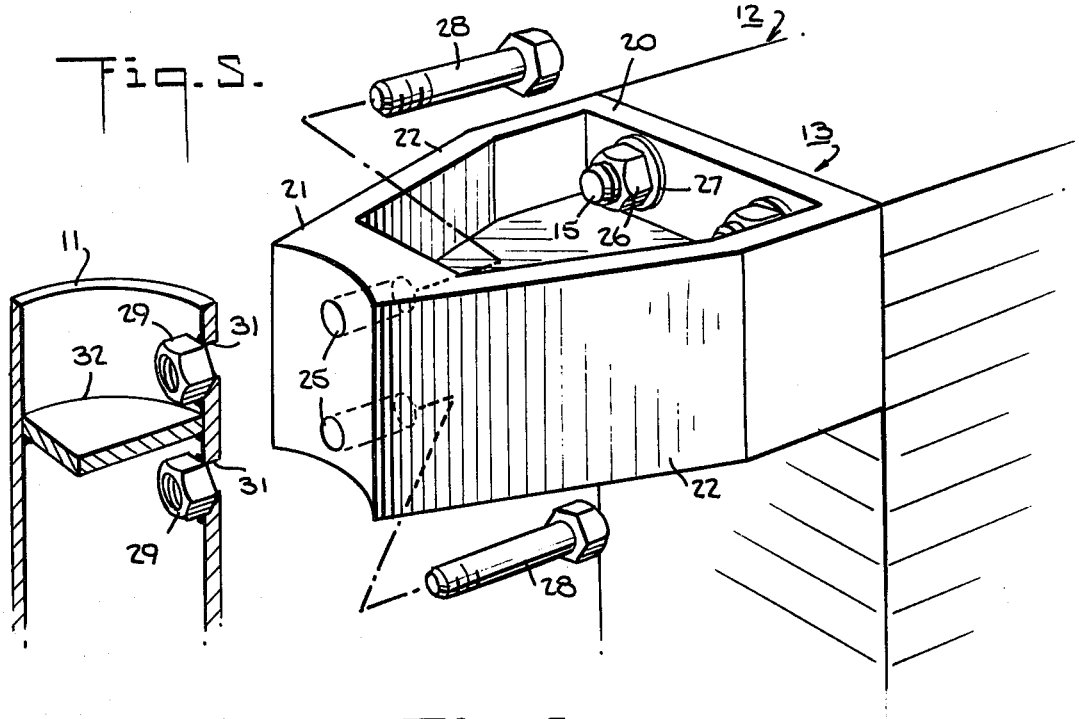
FIG. 5 illustrates an exploded view of a connector within a joint according to the invention.

In order to connect a timber 12 to the hub 11, a pair of connectors 13 are secured to the end face of a timber 12 by passing the connectors 13 over the exposed ends of each pair of tendons 15, 16 and by threading the nuts 26 onto the ends of the tendons 15, 16. After tightening of the nuts 26, the timber and connector unit is then lifted into place during construction and positioned so that the apertures 25 in the apex 21 of each connector 13 (see FIG. 5) and the apertures 31 in the hub 11 are aligned. The bolts 28 are then passed through the apex 21 of each connector 13 and are threaded into the nuts 29 within the hub 11 to secure the unit 13 firmly to the hub 11.

It is to be noted that the recesses of each connector 13 permits the securement of the connector 13 to the timber 12 and hub 11 in a manner so that the nuts 26 and bolts 28 do not unnecessarily project through the plane of the recess as indicated in FIG. 3. The minimum size of a recess is determined by the access needed to tighten the nuts 26 and bolts 28.

Figure 6:
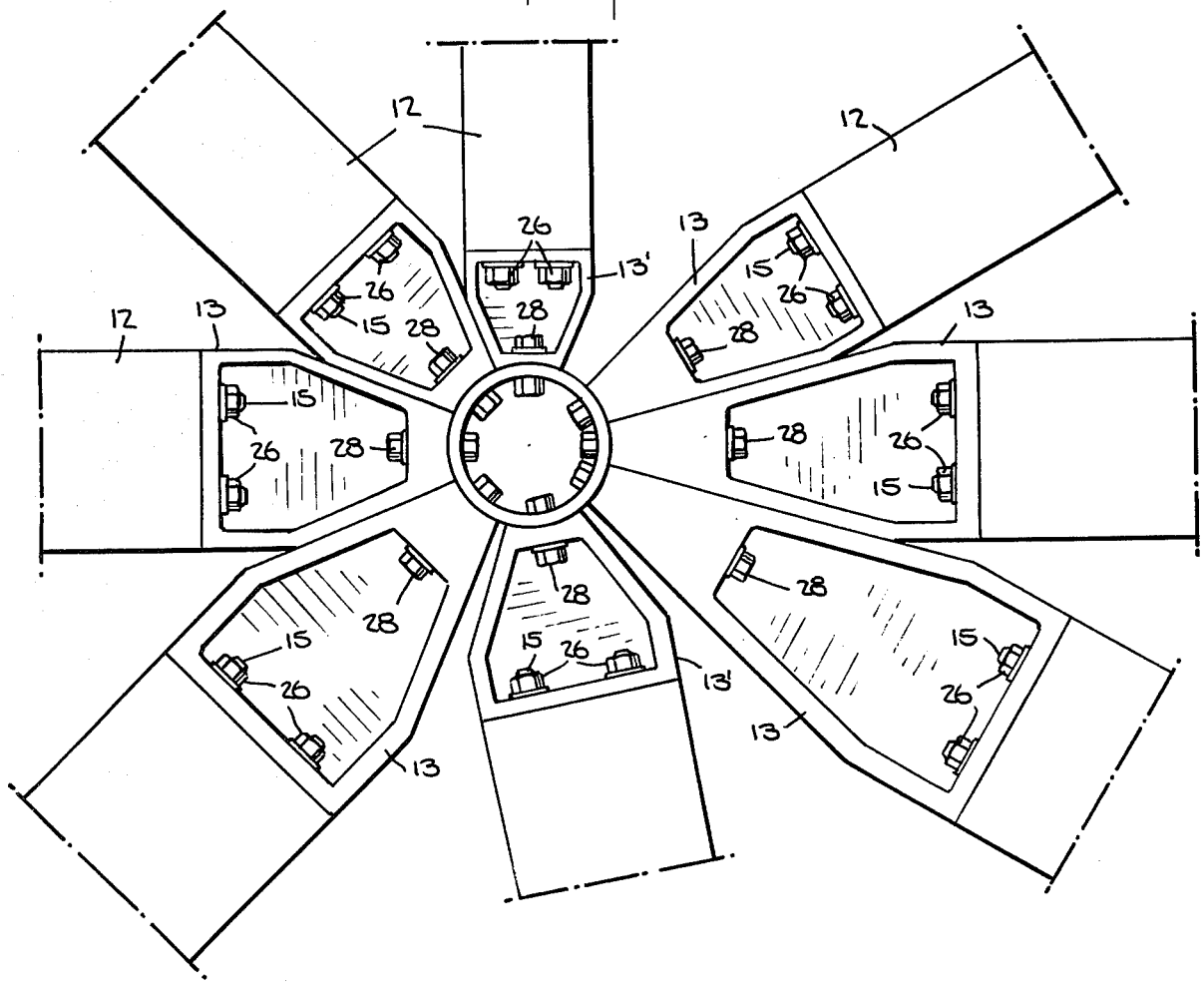
FIG. 6 illustrates a view similar to FIG. 1 of various sized connectors forming a joint of a space frame in accordance with the invention.

Referring to FIG. 6, where different sized timbers 12 are to be connected to the hub 11, the connectors 13 are suitably sized to accommodate the different sizes. To this end, the generated angle between two radiating timbers 12 determines the overall maximum length of a connector 13 while the timber ends determine the face width of a connector 13. As indicated in FIG. 6, adjacent connectors 13 may abut against each other to further stiffen the joint 10'.

As indicated, the connectors 13 may be of different radial lengths and widths and with converging side walls which define different enclosed angles.

Each timber 12 is made in a conventional laminated manner and is then drilled to have the bores 17 aligned in parallel to the grain. Thereafter, the holes 18 are drilled to communicate with the bores 17. After the rods 15, 16 are inserted, an epoxy resin 19 is injected via the holes 18 to secure the rods 15, 16 in place. The resulting units can then be transported from place to place with predrilled fully encasing wood blocks protecting the projecting tendon ends and lifted into position for securement to a hub 11.

When completed, the bolts 28 of each joint 10 are radially disposed relative to the cylindrical hub 11 with the pairs of tendons 15, 16 symmetrically of each timber 12. In this way, the stresses passing through the joint 10 are transferred in a symmetric manner without eccentric loadings.

Referring to FIGS. 7–9 wherein like reference characters indicate like parts as above, the joint 33 is composed of a connector 34 and a pair of timber structural members 12. As indicated, the structural members 12 are disposed in coaxial colinear relationship to each other and the connector 34 serves to connect or splice the two structural members 12 together.

The connector 34 is formed of a pair of box-shaped sections 35 which are disposed in spaced relation to each other and a web 36 which interconnects the two sections 35. Each section 35 includes a pair of oppositely disposed parallel bases 37 which abut the respective members 12 and a pair of stiffeners 38 which interconnect the bases 37. Each base 37 is provided with a pair of apertures 39 (see FIG. 8) through which the tendons 15, 16 of the structural members 12 pass.

The web 36 also extends into each box-shaped section and is located between the apertures 39 for the tendons 15, 16.

As above, nuts 26 thread onto the tendons 15, 16 to secure the connector 34 to and between the structural members 12.

As indicated in FIG. 8, the connector 34 is of a uniform width such that the width of the web 36 is the same as that of the box-shaped sections 35, while the height of the connector 34 is equal to the height, i.e., depth, of the structural members 12. As is also indicated, sufficient room remains within the recessed portions defined by the bases 37 and stiffeners 38 to permit threading of the nuts 26 onto the exposed ends of the respective tendons 15, 16 of the adjacent structural members 12. The connector 34 which is made of metal e.g. in standardized sizes may be mass produced by casting, forging or welding of plates together.

The connector 34 allows a transfer of all compressive and tensile stresses and thus produces a splice of a strength equal to uncut beams, i.e., the connector has 100% fixity.

Of note, the connector may be composed of a single box-shaped section for splicing two timber structure members together. In this case the connector would be approximately sized to the members being connected together.

Figure 10:
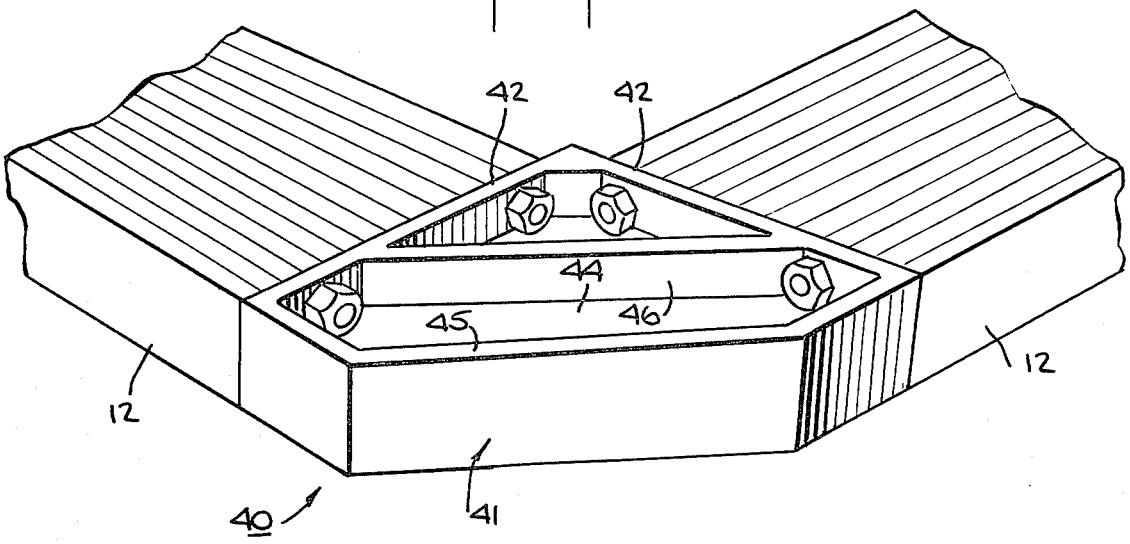
FIG. 10 illustrates a perspective view of a joint formed by a further modified connector according to the invention with two angularly disposed timber beams.
Figure 12:
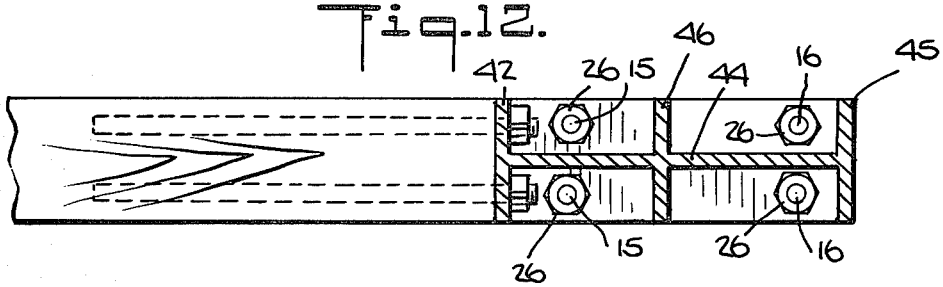
FIG. 12 illustrates a view taken of line 12—12 of FIG. 11.
Figure 11:
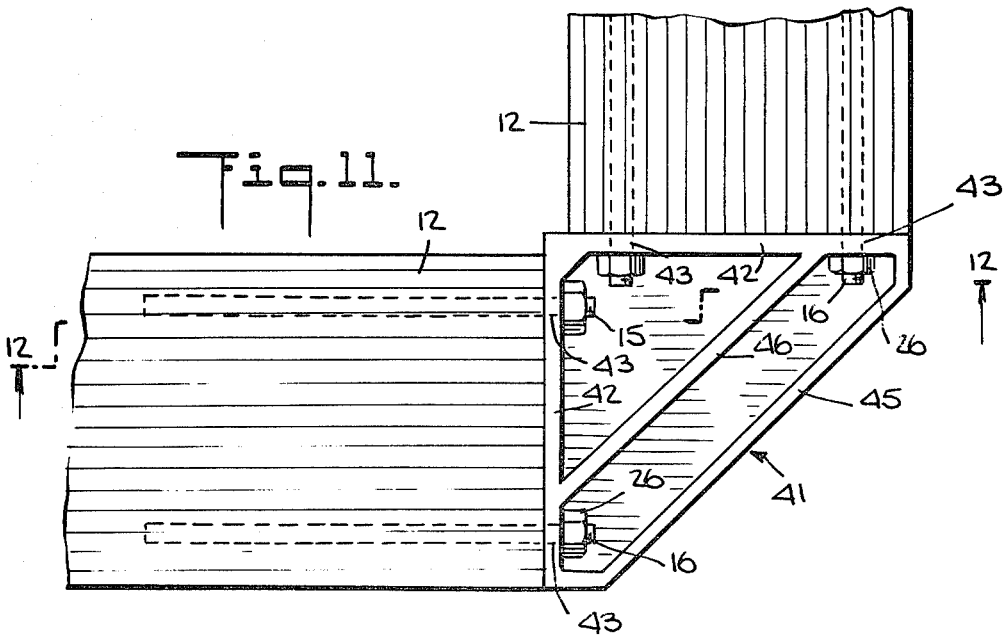
FIG. 11 illustrates a side view of the joint of FIG. 10.

Referring to FIGS. 10–12 wherein like reference characters indicate like parts as above, a joint 40 is formed by a one-piece connector 41 and a pair of structural members 12 which are disposed in angular relation to each other. The connector 41 has a pair of bases 42 which are disposed in angular relation to each other and abutted against the ends of the respective structural members 12. In addition, each base 42 has two pairs of apertures 43 for receiving the respective pairs of tendons 15, 16 of the structural members 12. Likewise, nuts 26 are threaded onto the respective tendons 15, 16 against suitable washers (not shown).

The connector 41 also has a web 44 interconnecting the bases 42. As indicated in FIGS. 10 and 12, the web 44 is located between the pairs of apertures 43 for the tendons 15, 16. In addition, a pair of stiffeners 45, 46 interconnect the bases 42 and web 44.

The connector 41 can be secured to the respective structural members 12 in a manner as described above. For example, the connector 41 may be secured to one structural member 12 and then lifted into place for securement to a previously erected structural member 12. Alternatively, the connector 41 can be secured to the two structural members 12 to form the joint 40 and thereafter be erected in place.

Of note, the outer stiffener 45 may be modified to receive a third structural member. To this end, the stiffener 45 would be provided with suitable pairs of apertures to receive the tendons of such a structural member. In this way, the connector 41 may be used to connect three structural members 12 in a star-like array.

As indicated in FIG. 10, suitable space is provided in the connector 41 for installation and tightening of the nuts 26 on the respective tendons 15, 16.

Of note, the bases 42 and the structural members 12 are shown in perpendicular relation. However, the angle of bent between the bases 42 and the structural members 12 may be of other values depending upon the joint being made.

As an alternative approach, each tendon may extend throughout the full length of a timber structural member 12. For example, such a tendon, in the form of a continuous rod with threaded ends, can be embedded either in the laminating process or later. Furthermore, the tendon can be composed of high tensile, small cross-sectional area rod within the bulk of the timber length which is welded or threaded into short threaded steel ends which project from the ends of the timber into the apertures of the various connectors.

The invention thus provides a connector, for example, of steel, which can be readily fabricated in standard sizes and which can be rapidly secured to a structural member such as laminated timber. Further, the invention provides a timber construction which can be readily adapted to mounting on a hub of a joint in a space frame construction or to connection with other timber constructions.

The invention further provides various structural members which can be readily connected to each other in order to form a secure joint in a space frame construction. In this regard, the timbers, connectors, and hubs can be readily transported from place to place and simply aligned with each other for the formation of a fixed joint.

In the case of a hub joint, the stresses imposed by each timber on the joint are readily transferred to the hub. In this regard, the embedded tendons are located in the regions of highest compression or tensile stress such that the timber need not be of unnecessary depth. Likewise, the bolts for securing each connector are radially aligned with the hub axis. Thus, eccentric transfer of loads can be avoided. Further, in those cases where the connectors of adjacent timbers abut each other, the joint is further stiffened against twisting.

It is to be noted that the tendons which are embedded in the timber not only provide for a transfer of load but also provide shear resistance. Further, the connectors reach 100% fixity. This provides the basis for alternative approaches to current methods of calculating stresses in reticulated timber domes, resulting in reduced structural member sizes due to the increased stiffness of the structure.

I claim:

1. A one piece connector for a structural member having a base for abutting an end of the structural member, said base having at least one aperture for receiving a tendon extending from the structural member, an apex of smaller width than said base for engaging a hub, said apex having at least one aperture for receiving a bolt therein, a pair of converging solid side walls between said base and said apex, and a solid web extending from said base to said apex transversely of said side walls.

2. A connector as set forth in claim 1 wherein said walls define an angle of from 25° to 90°.

3. A connector as set forth in claim 1 made of metal.

4. A connector as set forth in claim 1 wherein said base has a serrated surface for abutting a structural member.

5. A connector as set forth in claim 1 wherein said walls define an angle of from 30° to 60°.

6. In combination, an elongated timber structural member having at least one longitudinal bore in a compressive stress region at at least one end and at least one longitudinal bore in a tensile stress region at said end;

a plurality of threaded rods, each rod being embedded in a respective bore of said member and having one end extending from said end of said member;

at least one metallic connector disposed at said end of said member, said connector having a base with at least one aperture facing said end of said member to receive at least one of said rods, an apex spaced from said base, a pair of conveying side walls between said base and said apex and a web extending between said base and said apex; and a nut threaded onto an end of each rod received in said connector to secure said connector to said member.

7. The combination as set forth in claim 6 wherein said member has a rectangular cross-section and which further includes a pair of said connectors at said end of said member disposed in spaced relation to each other, each said connector being disposed in a respective compressive stress region and tensile stress region.

8. In combination, an elongated structural member having a plurality of threaded rods embedded therein with one end of each rod extending from one end of said member;

a connector having a base abutting said end of said member, a plurality of apertures in said base having said rods passing therethrough, a pair of converging side walls, an apex having at least one aperture for receiving a bolt therein and a web extending from said base to said apex transversely of said side walls; and nuts threaded onto said rods to secure said connector to said member.

9. In combination, a hub;

a plurality of timber structural members disposed in a radiating manner about said hub; and a plurality of connectors, each pair of said connectors securing a respective one of said members to said hub with each connector having converging side walls converging towards said hub, one of said pair of connectors being disposed in a compressive stress region of a respective member and the other of said pair of connectors being disposed in a tensile stress region of said respective member.

10. The combination as set forth in claim 9 wherein said hub is cylindrical and each connector has a rounded apex abutting said hub.

11. The combination as set forth in claim 10 wherein said hub is hollow and has at least one stiffener therein.

12. The combination as set forth in claim 9 which further includes at least one bolt securing a respective connector to said hub on an axis radial to said hub, at least one threaded rod embedded in a respective member and extending through said connector and a nut threaded onto an end of said rod to secure said connector to said member.

13. The combination as set forth in claim 12 wherein said hub has a plurality of tapped holes each receiving a respective one of said bolts.

14. The combination as set forth in claim 12 which includes a pair of said rods and said nuts securing each connector to a respective member, said pair of rods being disposed symmetrically of said respective axis.

15. In combination, a hollow cylindrical hub;

a plurality of timber structural members disposed in a radiating manner about said hub each member having at least one threaded rod embedded therein with one end extending from said member;

a plurality of connectors, each said connector having at least one rod passing therethrough for securement to a respective one of said member and having converging side walls converging towards said hub, each connector being of solid one-piece construction having recessed opposite sides to define a web; and bolts passing through each respective connector into said hub for securing each connector to said hub.

16. The combination as set forth in claim 15 wherein each said connector has a base abutting a respective member and wherein said web thereof is perpendicular to said base.

17. The combination as set forth in claim 15 wherein each said connector has a base abutting a respective member and wherein said web thereof is angularly disposed to said base.

* * * * *

UNITED STATES PATENT AND TRADEMARK OFFICE

CERTIFICATE OF CORRECTION

PATENT NO. : 4,484,430

DATED : November 27, 1984

INVENTOR(S) : Wendell E. Rossman

It is certified that error appears in the above-identified patent and that said Letters Patent is hereby corrected as shown below:

On the title page, Item (73) should read:

--Ensphere Concept International, Inc., Pheonix, Ariz.--.

Signed and Sealed this

*Thirteenth* Day of *August 1985*

[SEAL]

*Attest:*

DONALD J. QUIGG

*Attesting Officer* *Acting Commissioner of Patents and Trademarks*